US005505252A

United States Patent [19]

Mano

[11] Patent Number: 5,505,252

[45] Date of Patent: Apr. 9, 1996

[54] HEAT EXCHANGER

[75] Inventor: Hiroshi Mano, Nagoya, Japan

[73] Assignee: Rinnai Kabushiki Kaisha, Nagoya, Japan

[21] Appl. No.: 447,309

[22] Filed: May 22, 1995

[30] Foreign Application Priority Data

May 24, 1994 [JP] Japan ..... 6-110878

[51] Int. Cl.[6] ..... F28F 13/12

[52] U.S. Cl. ..... 165/109.1; 165/177; 126/99 A

[58] Field of Search ..... 165/109.1, 177, 165/178; 126/91 A, 99 A

[56] References Cited

U.S. PATENT DOCUMENTS

| | | | |
|---|---|---|---|
| 1,327,165 | 1/1920 | Merrit | 165/148 |
| 1,656,790 | 1/1928 | Heijkenskjold | 165/90 |
| 2,030,734 | 2/1936 | Baird | 165/109.1 X |
| 3,099,315 | 7/1963 | Loehj | 165/109.1 X |
| 4,981,170 | 1/1991 | Dierbeck | 165/109.1 |

FOREIGN PATENT DOCUMENTS

| | | | |
|---|---|---|---|
| 327760 | 7/1903 | France | 165/177 |
| 1119885 | 6/1956 | France | 165/177 |
| 25643 | 5/1897 | United Kingdom | 165/178 |

*Primary Examiner*—Allen J. Flanigan
*Attorney, Agent, or Firm*—Robbins, Berliner & Carson

[57] ABSTRACT

A heat exchanger which can prevent the increase of an internal resistance by baffle plates, can make the gradient of a heat exchange rate between an inlet side and outlet side more gradual, and can make uniform a temperature distribution of a fluid flowing outside.

3 Claims, 4 Drawing Sheets

HEAT EXCHANGER

BACKGROUND OF THE INVENTION

This invention relates to a heat exchanger which satisfies both the improvement in heat exchange efficiency and the reduction of a flow resistance.

A heat exchanger of the type which is formed by connecting a plurality of cylindrical members each having an increased diameter at an intermediate portion thereof and a reduced diameter at both ends thereof so as to provide a large heat exchange area and in which heat exchange is effected between an internal fluid flowing inside the heat exchanger and an external fluid flowing outside, has been used. In the heat exchanger of this type, a baffle plate is disposed at the increased diameter portion of each cylindrical member, and the internal fluid flowing inside the heat exchanger is so regulated as to flow along the inner wall of the increased diameter portion (intermediate portion) of each cylindrical member in order to improve heat exchange efficiency.

However, because the baffle plates provide a flow resistance to the internal fluid, a pressure loss of the heat exchanger increases. Further, when the whole of the internal fluid is caused to flow along the inner wall of the cylindrical members by the baffle plates, heat exchange is vigorously effected in the cylindrical member on the inlet side of the heat exchanger, while heat exchange on the outlet side is likely to remarkably decrease because the temperature of the internal fluid lowers in the cylindrical member on the outlet side. As a result a non-uniform temperature distribution is likely to develop in the external fluid flowing outside the heat exchanger in a direction crossing the flowing direction of the internal fluid flowing inside the heat exchanger.

SUMMARY OF THE INVENTION

It is an object of the present invention to provide a heat exchanger which can effectively prevent the increase of the internal resistance due to the baffle plates, can reduce the difference of the heat exchange rate between the cylindrical member on the inlet side and the cylindrical member on the outlet side, and can thus make uniform the temperature distribution of the external fluid flowing outside the heat exchanger in such a manner as to orthogonally cross the flowing direction of the internal fluid.

The heat exchanger according to the present invention has the construction in which a plurality of cylindrical members each having an increased diameter at an intermediate portion thereof and a reduced diameter at both ends thereof and having fitted to the intermediate portion thereof a baffle plate having outer peripheral flow holes defined at an outer peripheral portion and a central flow hole defined at a center are connected in series with one another, a predetermined proportion of an internal fluid flowing through the inside of the heat exchanger is allowed to flow through the outer peripheral flow holes and the rest is allowed to flow through the central flow hole.

According to an embodiment of the invention, the ratio of the flow rate of the outer peripheral flow holes to that of the central flow hole is set to be not greater than 2:1 and at least 1:2. Specifically each of the cylindrical members comprises a first shell member having a small connection port having a reduced diameter at one of the ends thereof and a large connection port having an increased diameter at the other end, and a second shell member having a large connection port having an increased diameter at one of the ends thereof and being to be butted against, and connected, to the large connection port of the first shell member, and a small connection port having a reduced diameter at the other end, and the baffle plate is clamped between, and fitted to, the butt surfaces.

According to the production method of the heat exchanger, the heat exchanger is produced by the steps of forming a first cylindrical member by butting a large connection port of a first shell member having a small connection port having a reduced diameter at one of the ends thereof and the large connection port having an increased diameter at the other end to a large connection port of a second shell member having substantially the same shape as that of the first shell member, interposing a baffle plate between the butt surfaces, and clamping and connecting hermetically the outer peripheries of the butt surfaces; forming a second cylindrical member to be connected to the first cylindrical member, by butting a small connection port of a third shell member having substantially the same shape as that of the first shell member, to a small connection port of the second shell member and clamping and connecting hermetically the third shell member to the second shell member, butting a large connection port of the third shell member to a large connection port of a fourth shell member having substantially the same shape as that of the second shell member, interposing a baffle plate between the butt surfaces, and clamping and connecting hermetically the outer peripheries of the butt surfaces; and connecting a predetermined number of cylindrical members by repeating sequentially the steps described above.

In the present invention, a suitable amount of the internal fluid flowing inside the heat exchanger flows from the central flow hole to a next cylindrical member. Accordingly, a turbulent flow occurring in the flow at the rear of the baffle plate becomes weak and a flow resistance can be reduced, so that a pressure loss becomes small. Further, the internal fluid flowing through the central flow hole is kept at a high temperature at a low heat exchange rate, flows under such a state into a next cylindrical member, and then mixes with the internal fluid that has passed through the outer peripheral flow holes at a high heat exchange rate and has been cooled to a low temperature. Accordingly, the occurrence of the phenomenon in which a major proportion of heat exchange is effected only in the cylindrical members on the inlet side can be prevented. Since the heat exchanger of this type is generally disposed orthogonally to the flowing direction of the external fluid, the temperature distribution of the external fluid subjected to heat exchange can be made uniform.

The reduction effect of the flow resistance and the uniforming effect of the temperature distribution are maximized when the ratio of the flow ratio of the outer peripheral holes to that of the central flow hole is not greater than 2:1 and at least 1:2.

Since the cylindrical member described in Claim 3 is simple in construction and has a small number of components, the production cost can be reduced.

According to the production method of Claim 4, the heat exchanger can be produced by sequentially laminating and clamping the shell members and the baffle plates. Therefore, production efficiency is high.

More particularly, the heat exchanger is formed by connecting a plurality of cylindrical members each having an increased diameter at an intermediate part thereof and a reduced diameter at both ends thereof and fitting baffle plates to the increased diameter portions of the cylindrical members each of the baffle plates has outer peripheral flow holes defined at the outer peripheral portion and a central flow hole defined at the center. At least four but at most eight cylindrical members are connected to one another and the ratio of flow rate of the outer peripheral flow hole to that of the central flow hole of an internal fluid flowing inside the heat exchanger is set to at least 1:2 but not greater than 2:1. This arrangement is desired for the purpose of reducing a pressure loss and making uniform the heat exchange proportion.

DETAILED DESCRIPTION

Figure 1:
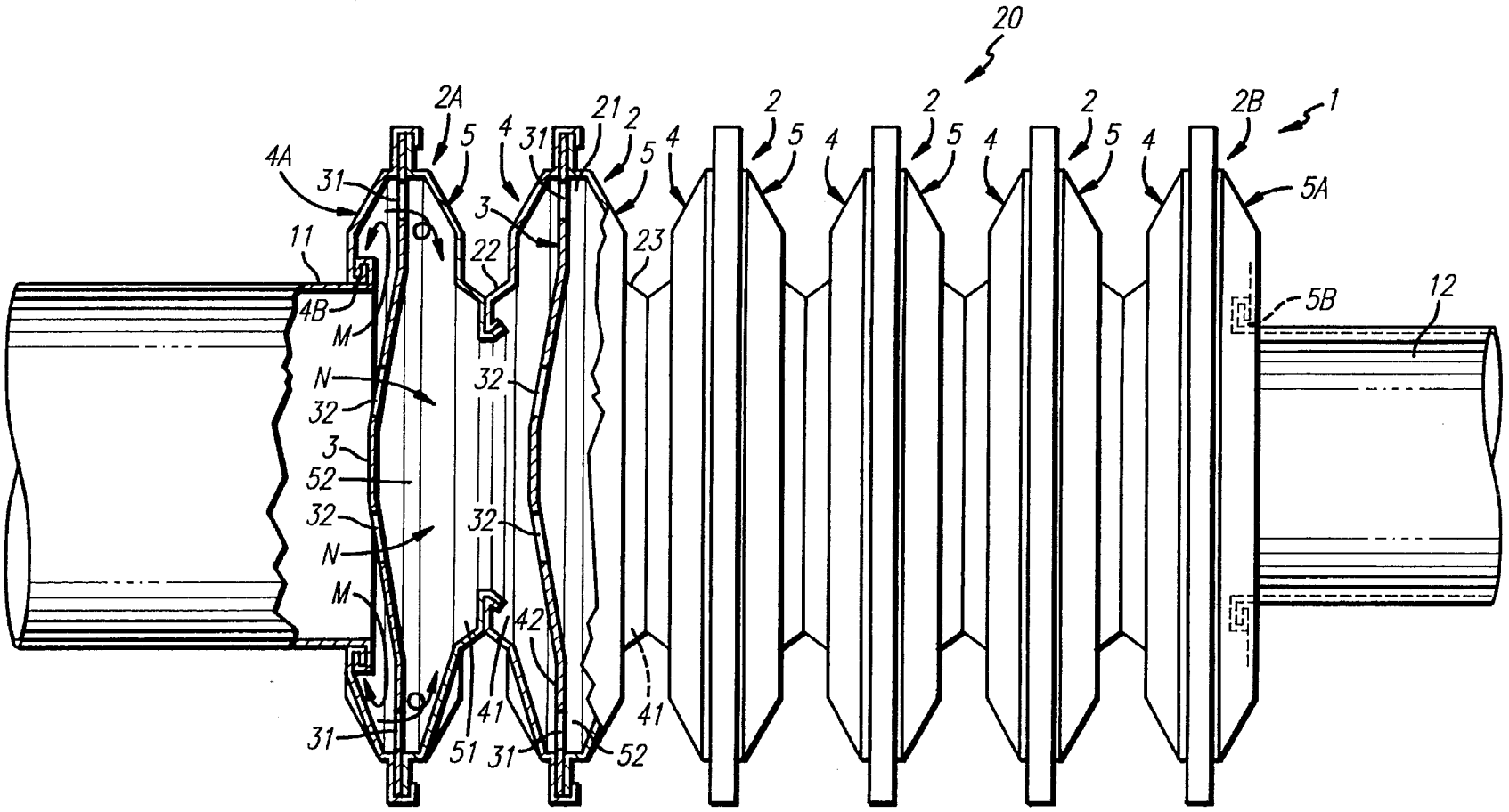
FIG. 1 is a front view of a heat exchanger.

FIG. 1 shows a heat exchanger 1 of a gas hot air heating apparatus according to one embodiment of the present invention which uses a combustion exhaust gas as an internal fluid and indoor air as an external fluid. The heat exchanger 1 is constituted by connecting six cylindrical members 2 between an inflow pipe 11 and an outflow pipe 12 of the internal fluid. Each of the cylindrical members 2 includes an intermediate portion 21 having an increased diameter and both end portions 22, 23 having a hollow cylindrical shape having a reduced diameter. A baffle plate 3 for regulating the internal fluid is fitted inside the intermediate portion 21 of each cylindrical member 2. The number of cylindrical members 2 constituting one heat exchanger 1 is determined appropriately in accordance with the heat exchange capacity, the limitation of a physical size, etc, but is preferably from four to eight from the aspect of heat exchange efficiency.

The intermediate cylindrical members 2 among a line 20 of the six cylindrical members described above other than the cylindrical member 2A on the inflow side connected to the inflow pipe 11 having an increased diameter and the cylindrical member 2B on the outflow side connected to the outflow pipe 12 having a reduced diameter all have the following same construction.

A first shell member 4 having a small connection port 41 having a reduced diameter atone of the ends thereof and a large connection port 42 having an increased diameter at the other end and a second shell member 5 having a small connection port 51 having a reduced diameter and a large connection port 52 having an increased diameter at the other end are butted against each other at their large connection ports 42 and 52. The baffle plate 3 described above is clamped between the butt surfaces and the outer peripheries of these butt surfaces are clamped and is hermetically connected.

Figure 2:
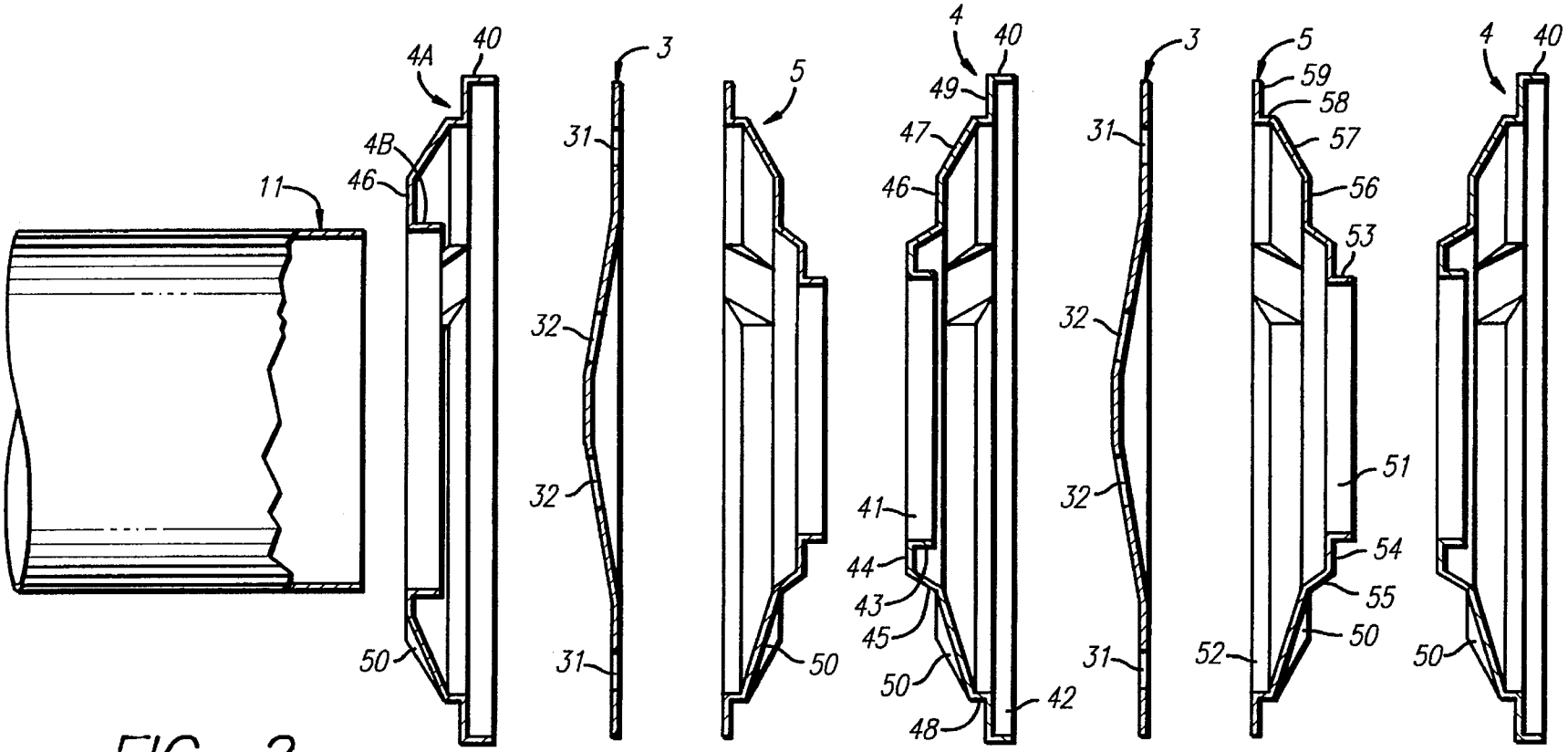
FIG. 2 is an exploded view of a cylindrical member.

In this embodiment, the first shell member 4 is shaped by pressing a heat-resistant metal plate as shown in FIG. 2, and an inner cylindrical portion 43 as a caulking margin is so formed as to protrude in a downstream direction (the fight-hand direction in the drawing) at the small connection port 41 which is set on the upstream side (the left-hand direction in the drawing). A ring-like butt flat surface 44 is disposed around the outer periphery of the inner cylindrical portion 43, and an inner conical surface 45 is so formed around the outer periphery of this butt flat surface 44 as to extend therefrom. A ring-like flat surface 46 is so formed around the outer periphery of the inner conical surface 45 as to extend therefrom. An outer conical surface 47 is further formed around the outer periphery of the ring-like flat surface 46, and a cylindrical portion 48 is so formed as to extend from the outer periphery of the outer conical surface 47 toward the downstream side. A flange portion 49 as a butt surface is annularly formed from the rear end portion of this cylindrical portion 48. An outer cylindrical portion 40 as a caulking margin is formed around the outer periphery of the flange portion 49 in such a manner as to extend in the downstream direction.

The first shell member 4 and the second shell member 5 have the same shape with the exception of the difference between the inner cylindrical portion 43 and the inner cylindrical portion 53 as the caulking margin and the difference between the outer cylindrical portion 40 and the flange portion 59. The second shell member 5 is formed by press molding, and an inner cylindrical portion 53 which fits to the inner cylindrical portion 43 is formed at the connection port 51 having a reduced diameter, which is set on the downstream side, in such a manner as to protrude in the downstream direction. A ring-like butt surface 54 is formed around the outer periphery of the inner cylindrical portion 53, and an inner conical surface 55 is formed in such a manner as to extend from the outer periphery of the butt surface 54. Further, a ring-like flat surface 56 is formed around the outer periphery of the inner conical surface 55. An outer conical surface 57 is formed around the outer periphery of the ring-like flat surface 56, and a cylindrical portion 58 is extended from the outer periphery of the outer conical surface 57 toward the downstream side. A flange portion 59 as a butt surface is annularly formed in such a manner as to extend from the rear end of the cylindrical portion 58.

Three recesses 50 comprising a flat surface swelling inside the shell member and inclined in a radial direction are equidistantly formed in the ring-like flat surface 46 and the outer conical surface 47, and in the ring-like flat surface 56 and the outer conical surface 57, and improve the mechanical strength of each shell member as a rib.

The first shell member 4 and the second shell member 5 are hermetically connected to each other by butting the flange portion 49 of the large connection port 42 and the flange portion 59 of the large connection port 52 while clamping the baffle plate 3 between them, caulking the outer cylindrical portion 40 inward and wrap-clamping it around the outer peripheral portion of the flange portion 59.

The second cylindrical member 2 connected to the cylindrical member 2 described above is hermetically connected by butting the small connection port 41 of the third shell member 4, which is the same as the first shell member 4, against the small connection port 51 of the second shell member 5 in the first cylindrical member 2 and caulking the inner cylindrical portion 43 and the inner cylindrical portion 53 in an expanding direction. Next, the large connection portion 42 of the third shell member 4 and the large connection port 52 of the fourth shell member 5, which is the same as the second shell member 5, are butted against each other, the baffle plate 3 is then clamped between both butt surfaces, and the outer peripheries of the butt surfaces is caulked and is hermetically connected.

The heat exchanger 1 is produced by connecting a predetermined number of cylindrical members 2 by sequentially repeating the steps described above.

Figure 3B:
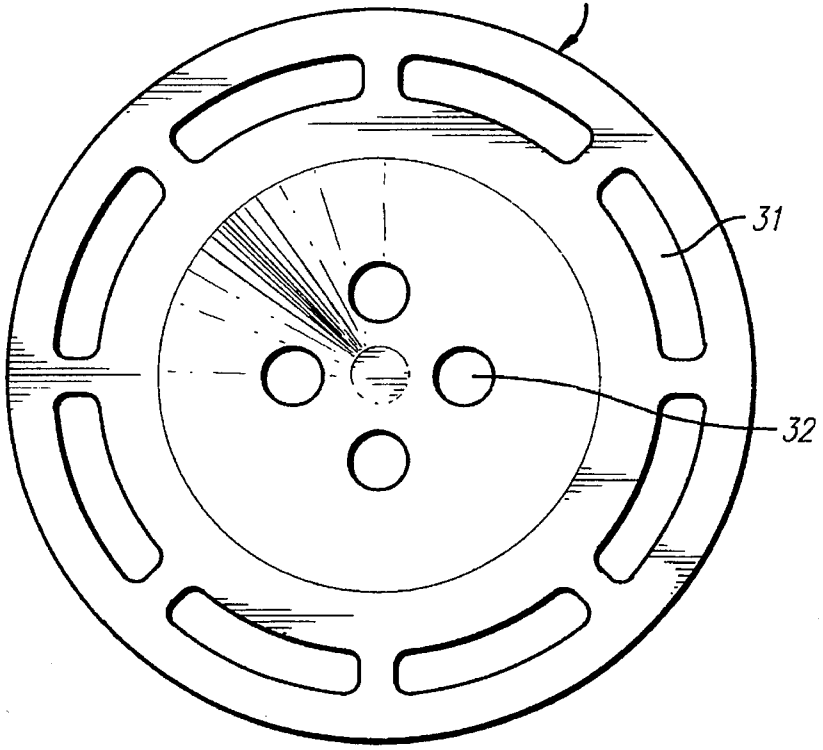
FIG. 3 is a left-hand side view of a first shell member and a baffle plate.
Figure 3A:
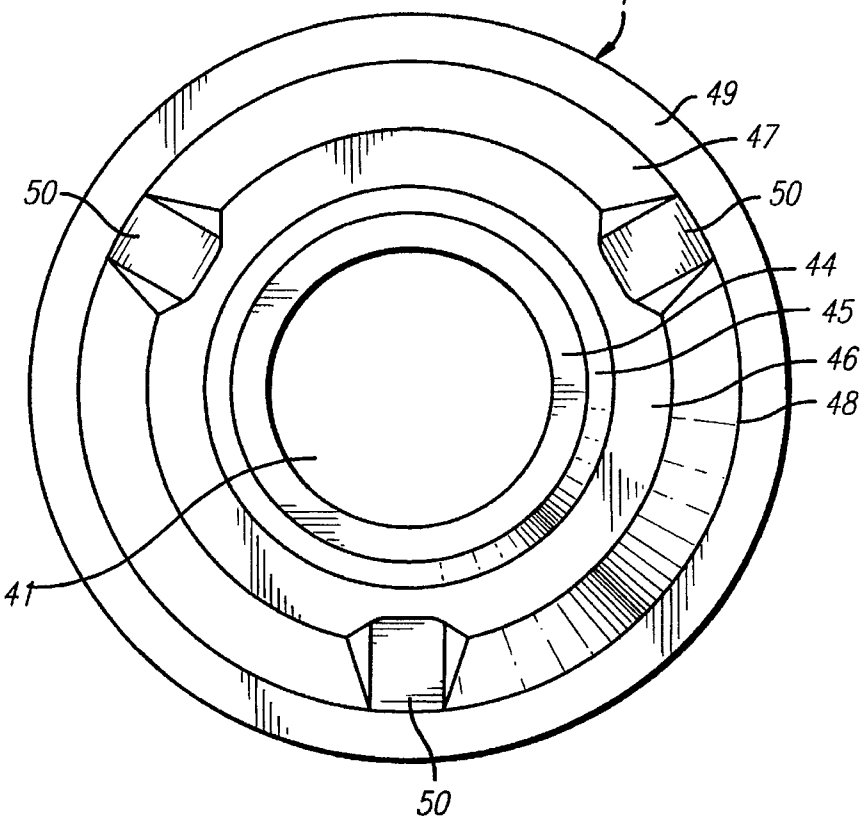

As shown in FIG. 2, the cylindrical member 2A on the inflow side is equipped on the inner periphery of the ring-like flat surface 46 with an inner cylindrical portion 4B as a caulking margin which protrudes toward the downstream side for the purpose of connection with the inflow pipe 11 of the shell member 4A on the upstream side. The distal end portion of the inflow pipe 11 is inserted into this inner cylindrical portion 4B, and is wound and fastened (co-winding) in the expanding direction as shown in FIG. 3. The other construction is the same as that of the intermediate cylindrical member 2.

The cylindrical member 2B on the outflow side is equipped on the shell member 5A on the downstream side with the inner cylindrical portion 5B as the caulking margin on the inner periphery of the ring-like flat surface 56 which protrudes on the upstream side. The distal end portion of the outflow pipe 12 is inserted into this inner cylindrical portion and is wound and fastened (co-winding) in the expanding direction in the same way as described above. The other construction is the same as that of the intermediate cylindrical member 2.

The outer diameter of the baffle plate 3 is set to be the same size as the outer diameter of the flange portions 49, 59, and its central portion has a shape of a circular truncated cone which swells toward the upstream side. The baffle plate 3 undergoes swelling due to the heat of the combustion exhaust gas as the internal fluid during use, and this circular truncated cone unifies the expanding direction between the baffle plates. In this way, it becomes possible to prevent variations of the expanding directions of the baffle plates 3 when they undergo swelling due to variance in the production and assembly. As a result, the disadvantages such as variance of heat exchange performance, the generation of noise when the baffle plate 3 returns from the swollen state to the flat plate, etc, can be avoided.

A slit hole group comprising eight outer peripheral flow holes 31 which have a fan shape and are disposed equidistantly is formed at the outer peripheral portion of each baffle plate 3. The formation positions of these outer peripheral flow holes 31 in the radial direction correspond to the outer conical surfaces 47, 57. A round hole group comprising four central flow holes 32 formed equidistantly on the same circumference is disposed at the conical surface portion at the center. By the way, the outer flow hole 31 may be a notch and the central flow hole 32 may be a slit, and the shape of the holes and their number can be selected appropriately. Though this embodiment uses the shape of the circular truncated cone, the same effect can be obtained when the shape is spherical, too.

In order to reduce the flow resistance and to accomplish uniform heat exchange efficiency throughout the entire length, the ratio of the flow rate of the slit hole group of the outer peripheral flow holes 31 to that of the round hole group of the central flow holes 32 is preferably at least 1:2 and at most 2:1.

When directionality in fitting is provided to the baffle plate 3 and the open area of the outer peripheral flow hole 31 on the upstream side of the flow of the external fluid, that is, on the upstream side of the heat exchanger, is made greater than that on the downstream side, the heat exchange proportion to the external fluid having a lower temperature on the upstream side can be made greater and heat exchange efficiency can be improved.

When the open area of the outer peripheral flow hole 31 of the baffle plate 3 positioned on the upstream side of the heat exchanger is made greater then that on the downstream side, the heat exchange proportion to the external fluid having a lower temperature can be made uniform.

The internal fluid flowing through the heat exchanger 1 is deflected by the baffle plate 3 as indicated by arrows in FIG. 1, and at least ⅓ but less than ⅔ of the fluid passes through the outer peripheral flow holes 31 while less than ⅔ but at least ⅓ of the fluid passes through the central flow holes 32.

The internal fluid M passing through the outer peripheral flow holes 31 flows along the inner walls of the ring-like flat surfaces 46, 56, the outer conical surfaces 47, 57 and the cylindrical portions 48, 58, changes to a turbulent flow, and efficiently exchanges heat with the external fluid, though the flow resistance is great.

The internal fluid N passing through the central flow holes 32 is hardly subjected to heat exchange but flows downstream of the baffle plates 3 with a small flow resistance. The internal fluid M and the internal fluid N mix with each other downstream of the baffle plate 3 and the mixture is supplied to the cylindrical member 2 on the downstream side.

Accordingly, because heat exchange is gradually effected in the heat exchanger 1 throughout its full length, heat exchange efficiency becomes uniform from the cylindrical member 2A on the inflow side to the cylindrical member 2B on the outflow side. As a result, the temperature distribution of the external fluid subjected to the heat exchange can be made uniform. Further, because the flow resistance of the central flow holes 32 is small, the overall pressure loss can be reduced.

Figure 4:
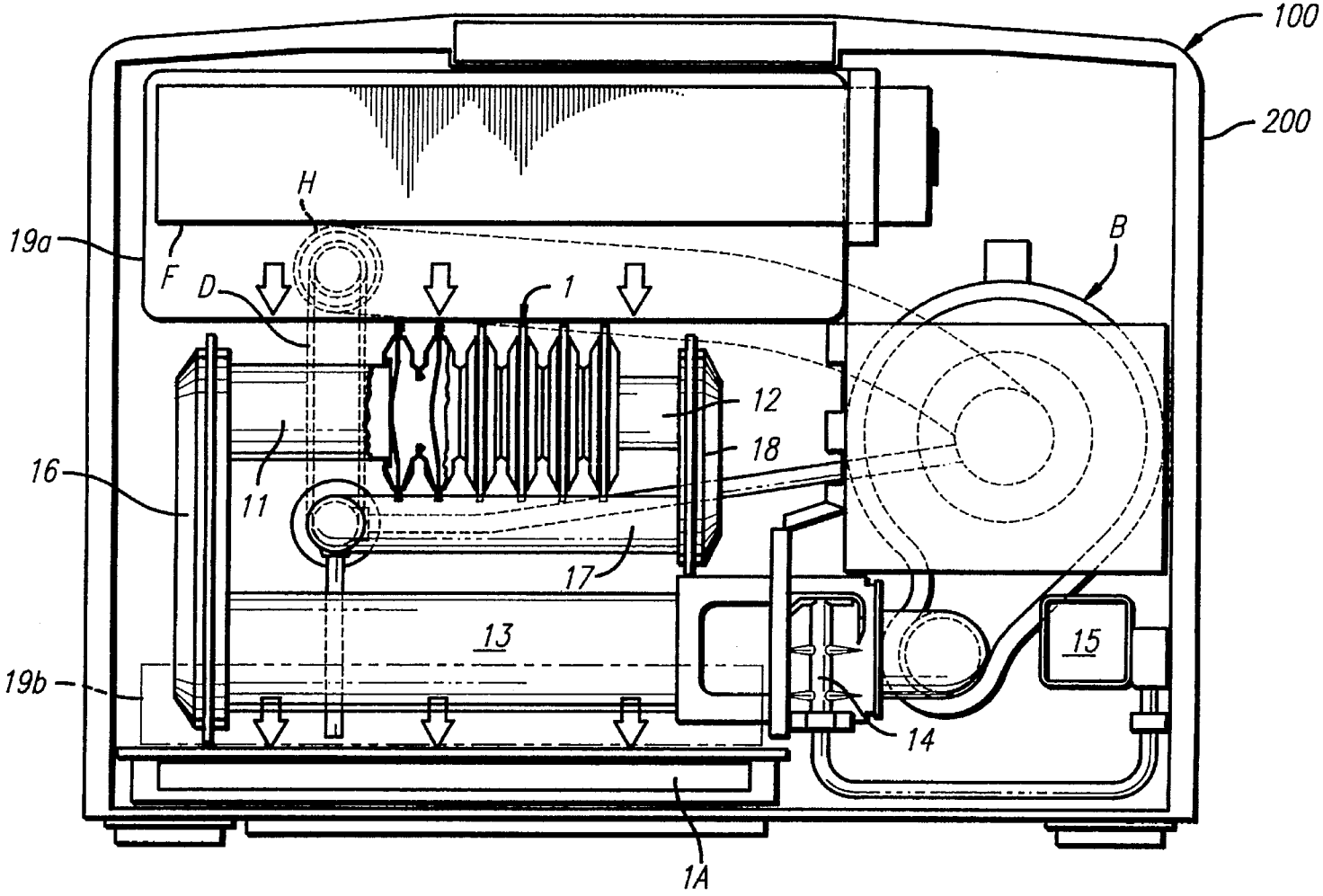
FIG. 4 is a front view showing the internal structure of the gas hot air heater.

FIG. 4 shows a gas hot air heater 100 equipped with the heat exchanger 1 according to the present invention. In this hot air heater 100, an centrifugal type combustion blower B is mounted to the right side portion of a flat casing 200 formed by thin plate working and elongated in the transverse direction, and a transverse cylindrical combustion cylinder 13 is disposed at a lower portion of the casing 200. A gas burner 14 is fitted to the right end portion of the combustion cylinder 13 and combustion air is supplied to it from the blower B, is mixed with a gas supplied from a control mechanism 15 of a fuel gas and is burnt.

The heat exchanger 1 is transversely disposed above the combustion cylinder 13 inside the casing 200. The left-hand end of the combustion cylinder 13 and the left-hand end of the inflow pipe 11 are connected by a connecting cylinder 16 having a square section.

An exhaust cylinder 17 is interposed between the heat exchanger 1 and the combustion cylinder 13 in parallel with them. The right-hand end of the outflow pipe 12 connected to the right-hand end of the heat exchanger 1 is connected to the right-hand end of the exhaust cylinder 17 by a connecting cylinder 18 having a square section. The distal end (left-hand end) of the exhaust cylinder 17 penetrates through the back plate of the casing 200 and protrudes rearward. It is further connected to an exhaust outer pipe D disposed in a feed/exhaust hole H which is so defined on the chamber wall as to communicate the inside of the chamber with the outside.

A fan F for blowing heating air having a thinly elongated cylindrical fan is disposed transversely at the upper part of the casing 200. This fan F for blowing heating air blows forward indoor air, sucked from an indoor air suction port **19*a* defined at the upper part of the back plate of the casing 200, via a hot air blow port 19*b* defined at the lower part of the front plate of the casino 200. Air for heating flows around the heat exchanger 1, the exhaust pipe 17 and the combustion cylinder 13 as represented by a blank arrow, is so subjected to heat exchange, reaches a high temperature and is blown forward via the hot air blow port 19*b*. A water pan 1A for humidification is placed on the bottom plate of the casing below the combustion cylinder 13 inside the casing 200** in such a manner that it can be pulled out forward.

Since heating air is uniformly heated and blown out into the room in this gas hot air heater, the heater has a high heating effect.

We claim:

1. A heat exchanger formed by connecting in series a plurality of cylindrical members each having an increased diameter at an intermediate portion thereof and a reduced diameter at both ends thereof and having mounted to said intermediate portion thereof a baffle plate having outer peripheral flow holes defined at an outer peripheral portion and a central flow hole defined at a center, wherein a predetermined proportion of an internal fluid flowing through the inside of said heat exchanger is allowed to flow through said outer peripheral flow holes and the rest of said internal fluid is allowed to flow through said central flow hole.

2. A heat exchanger according to claim 1, wherein a ratio of flow rate of said outer peripheral flow holes to that of said central flow hole is not greater than 2:1 and at least 1:2.

3. A heat exchanger according to claim 1, wherein said cylindrical member comprises a first shell member having a small connection port having a reduced diameter at one of the ends thereof and a large connection port having an increased diameter at the other end, and a second shell member having a large connection port having an increased diameter at one of the ends thereof and being to be butted against, and connected to, said large connection port of said first shell member, and a small connection port having a reduced diameter at the other end, and said baffle plate is clamped between, and fitted to, the butt surfaces.

* * * * *